US005576818A

United States Patent [19]

Badesha et al.

[11] Patent Number: 5,576,818

[45] Date of Patent: Nov. 19, 1996

[54] INTERMEDIATE TRANSFER COMPONENT HAVING MULTIPLE COATINGS

[75] Inventors: Santokh S. Badesha, Pittsford; George J. Heeks, Rochester; Arnold W. Henry, Pittsford, all of N.Y.

[73] Assignee: Xerox Corporation, Stamford, Conn.

[21] Appl. No.: 494,512

[22] Filed: Jun. 26, 1995

[51] Int. Cl.[6] ..... G03G 15/14; G03G 13/20

[52] U.S. Cl. ..... 355/271; 355/273; 430/124; 430/126

[58] Field of Search ..... 355/271–273, 355/277, 274, 275; 430/126, 124

[56] References Cited

U.S. PATENT DOCUMENTS

| | | | |
|---|---|---|---|
| 3,893,761 | 7/1975 | Buchan et al. | 355/272 |
| 4,684,238 | 6/1986 | Till et al. | 355/275 |
| 4,690,539 | 9/1987 | Radulski et al. | 355/326 R |
| 5,027,159 | 6/1991 | Oda et al. | 355/271 |
| 5,099,286 | 3/1992 | Nishise et al. | 355/272 |
| 5,110,702 | 5/1992 | Na et al. | 430/99 |
| 5,119,140 | 6/1992 | Berkes et al. | 355/273 |
| 5,132,743 | 7/1992 | Bujese et al. | 355/274 |
| 5,150,161 | 9/1992 | Bujese | 355/256 |
| 5,208,638 | 4/1993 | Bujese et al. | 355/271 X |
| 5,298,956 | 3/1994 | Mammino et al. | 355/273 X |
| 5,337,129 | 8/1994 | Badesha | 355/273 X |
| 5,340,679 | 8/1994 | Badesha et al. | 430/126 |
| 5,347,353 | 9/1994 | Fletcher | 355/272 X |
| 5,361,126 | 11/1994 | Loonen et al. | 355/271 X |
| 5,409,557 | 4/1995 | Mammino et al. | 430/126 X |
| 5,434,659 | 7/1995 | Berkes et al. | 355/273 |
| 5,459,008 | 10/1995 | Chambers et al. | 430/126 X |

FOREIGN PATENT DOCUMENTS

0638854A1 2/1995 European Pat. Off. .

*Primary Examiner*—Matthew S. Smith
*Attorney, Agent, or Firm*—Zosan S. Soong

[57] ABSTRACT

There is disclosed an intermediate toner transfer component including: (a) an electrically conductive substrate; (b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

14 Claims, No Drawings

INTERMEDIATE TRANSFER COMPONENT HAVING MULTIPLE COATINGS

BACKGROUND OF THE INVENTION

This invention relates generally to an imaging apparatus and intermediate toner transfer components thereof. More specifically, the present invention is directed to an imaging apparatus and process wherein an electrostatic latent image is formed on an imaging member and developed with a toner, followed by transfer of the developed image to a coated intermediate transfer belt or component and subsequent transfer with very high transfer efficiency of the developed image from the intermediate transfer element to a permanent substrate.

Although known processes and materials are suitable for their intended purposes, a need remains for imaging apparatuses and processes employing intermediate coated transfer elements or components with high transfer efficiencies to and from intermediates, which can be in the form of a belt. In addition, there is a need for imaging apparatuses and processes employing coated intermediate transfer elements that enable generation of full color images with high color fidelity. Further, a need exists for imaging apparatuses and processes employing coated intermediate transfer elements that can be selected for both liquid and dry toner development systems. There is also a need for imaging apparatuses and processes employing intermediate transfer elements that enable simplified and improved registration of superimposed images of different colors on a single substrate sheet to form multicolor or blended color images. Furthermore, there is a need for imaging apparatuses which possess acceptable thermal stability, excellent chemical stability, and also have physical and mechanical stability. There is also a need for imaging apparatuses wherein there are selected low surface energy transfer belts and which belts may be utilized in dry or liquid xerographic imaging and printing systems and processes. Chemical stability as mentioned herein refers, for example, to resistance attack from dry and liquid toners and developers, in view of the contact of the transfer element with the liquid carrier, charge additive, charge directors, toner resins, and pigments. There is also a need for intermediate transfer components which have excellent transfix characteristics and excellent heat transfer characteristics.

Examples of an intermediate transfer member can be found in the following documents:

European Patent Application 0638854A1 discloses an intermediate transfer member comprising a substrate, a conductive fluorine rubber layer, an adhesive layer, and a silicone rubber layer as the top layer.

Gundlach et al., U.S. Ser. No. 08/316,017 (attorney docket no. D/92624i), filed Sep. 30, 1994, discloses on page 19 an intermediate member employed as an electroreceptor, wherein the intermediate member comprises a two layer structure which can be optionally mounted onto a rigid member. Preferably, both layers are composed of VITON™ which can be laminated together.

Ng et al., U.S. Pat. No. 5,110,702, discloses non-electrostatic transfer of a toned image using a roll as an intermediate transfer member.

Buchan et al., U.S. Pat. No. 3,893,761, discloses an intermediate transfer belt having a polyimide film substrate coated with 0.1 to 10 mils of silicone rubber or a fluoroelastomer.

Till et al., U.S. Pat. No. 4,684,238 and Radulski et al., U.S. Pat. No. 4,690,539, disclose single layer intermediate transfer belts composed of polyethylene terephthalate or propylene material which are employed in liquid development methods and apparatus.

Berkes et al., U.S. Pat. No. 5,119,140, discloses a single layer intermediate transfer belt fabricated from clear TEDLAR™, carbon loaded TEDLAR™ or pigmented TEDLAR™.

Nishise et al., U.S. Pat. No. 5,099,286, discloses an intermediate transfer belt comprising electrically conductive urethane rubber as the substrate and a layer of polytetrafluoroethylene.

Bujese, U.S. Pat. No. 5,150,161, discloses suitable materials for laminate intermediate transfer members in a color printing apparatus, reference for example col. 7, line 48 to col. 8, line 38, and col. 11, lines 46–53.

Badesha et al., U.S. Pat. No. 5,340,679 (Attorney Docket No. D/92564), discloses an intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator.

Bujese et al., U.S. Pat. No. 5,132,743, discloses an intermediate transfer member which employs a conductive fluorosilicone layer.

SUMMARY OF THE INVENTION

It is an object of the present invention to provide coated intermediate transfer components suitable for liquid and dry toner development systems.

It is also an object in embodiments to provide imaging apparatus and intermediate toner transfer components exhibiting high toner transfer efficiencies to and from the intermediate transfer component.

It is a further object in embodiments to enable generation of full color images with high color fidelity in imaging apparatus employing an intermediate transfer component.

It is an additional object to provide new intermediate toner transfer components which possess one or more of the following attributes: excellent chemical stability wherein the toner release layer minimally reacts or do not react with the components of the liquid and dry toners and developers including the toner resin, pigment(s)/dye(s), charge control additive(s), charge director(s), and carrier fluid; low surface energy; suitable dielectric thickness; suitable electrical conductivity; suitable thermal conductivity; good physical and mechanical stability; and good conformability.

These objects and others are accomplished in embodiments by providing an intermediate toner transfer component comprising:

(a) an electrically conductive substrate;

(b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

There is also provided in embodiments an electrostatographic printing apparatus comprising:

(a) an imaging member for recording a latent image;

(b) a developing device for developing the latent image with a toner composition to form a toner image;

(c) an intermediate toner transfer component, positioned adjacent the imaging member, comprising:

(i) an electrically conductive substrate, (ii) a conformable and electrically resistive layer comprised of a first polymeric material, and (iii) a toner release layer comprised of a second polymeric material selected from the group consisting of a fluorosilicone and a substantially uniform integral interpenetrating network of a hybrid composition of a fluoroelastomer and a polyorganosiloxane; and (d) a transfer apparatus for transferring the toner image from the imaging member to the intermediate toner transfer component.

DETAILED DESCRIPTION

An illustrative intermediate toner transfer component of the present invention includes the following substituents in the cited sequence: a substrate, an optional first adhesive layer, a conformable resistive layer, an optional second adhesive layer, and a toner release layer. The various layers may be applied to the substrate by any suitable coating technique including for example spraying, draw, web, flow, and dip coating.

An advantage of the present invention is that the materials for each of the layers can be optimized for the particular desired function. For example the conformable resistive layer can be optimized to provide sufficient physical thickness to give the required conformability while minimizing the dielectric thickness. The release layer can be optimized to allow an electrical field to be applied for electrostatic transfer of the image and to exhibit optimum toner release properties. The release layer also can be optimized in embodiments for wear resistance, and optionally for resistance to a liquid carrier when a liquid developer is used. In contrast, in conventional designs, the single overcoating layer on the substrate must accommodate all the desired functions with resulting compromises in material choice and performance.

Examples of materials for the substrate include polyvinyl fluoride, such as TEDLAR®, available from E.I. DuPont de Nemours & Company, polyvinyl fluoride loaded with conductive or dielectric fillers such as carbon particles, titanium dioxide, barium titanate, or any other filler capable of decreasing dielectric thickness, polyvinylidene fluoride, such as KYNAR®, available from Pennwalt Corporation, polyvinylidene fluoride loaded with conductive or dielectric fillers such as carbon particles, titanium dioxide, barium titanate, or any other filler capable of decreasing dielectric thickness, certain papers, such as Xerox Corporation 4024 paper or Xerox Corporation Series 10 paper, and the like. In addition, metals that can be coated include aluminum, copper, brass, nickel, zinc, chromium, stainless steel, semi-transparent aluminum, steel, cadmium, silver, gold, indium, tin, and the like. Metal oxides, including tin oxide, indium tin oxide, and the like, are also suitable. Any other material having the desired charge relaxation characteristics can also be employed. Fillers employed to alter the relaxation time of a material may be present in any amount necessary to effect the desired relaxation time; typically, fillers are present in amounts of from 0 to about 80 percent by weight. When paper or other materials for which conductivity is affected by relative humidity is used as the substrate, the relative humidity may have to be controlled during the imaging process to maintain the intermediate transfer element at the desired charge relaxation time. In general, intermediate transfer elements of materials for which the charge relaxation time changes significantly with relative humidity perform optimally at relative humidities of 60 percent or less. Preferably, the substrate is a metal, a metal oxide, a thermoplastic or a thermosetting organic film, including the materials disclosed herein. In embodiments, the substrate comprises polyimide, optionally including carbon black.

The conformable resistive layer may comprise for example a polymeric material and conductive particles. The conformability is required to have adequate fix level of the image. The electrical resistivity is required for the electrostatic transfer of the image from the image receptor to the intermediate belt and from the belt to the paper. The mechanical strength is required for the wear and tear (life). Thermal conductivity and thermal stability is needed for image fix and life of the belt. The electrical resistivity of the resistive layer ranges for example from about $10^7$ to about $10^{11}$ ohm cm, preferably from about $10^8$ to about $10^{10}$ ohm cm, and more preferably about $10^9$ ohm cm.

The polymeric material is preferably a haloelastomer which may be any suitable halogen containing elastomer such as a chloroelastomer, a bromoelastomer, a fluoroelastomer, or mixtures thereof. Fluoroelastomer examples include those described in detail in U.S. Pat. No. 4,257,699 to Lentz, as well as those described in Eddy et al., U.S. Pat. No. 5,017,432 and Ferguson et al., U.S. Pat. No. 5,061,965, the disclosures of which are totally incorporated by reference. As described therein these fluoroelastomers, particularly from the class of copolymers and terpolymers of vinylidenefluoride hexafluoropropylene and tetrafluoroethylene, are known commercially under various designations as VITON A™, VITON E™, VITON E60C™, VITON E430™, VITON 910™, VITON GH™ and VITON GF™. The VITON™ designation is a Trademark of E.I. Dupont deNemours, Inc. Other commercially available materials include FLUOREL 2170™, FLUOREL 2174™, FLUOREL 2176™, FLUOREL 2177™ and FLUOREL LVS 76™, FLUOREL™ being a Trademark of 3M Company. Additional commercially available materials include AFLAS™ a poly(propylene-tetrafluoroethylene), FLUOREL II™ (LII900) a poly(propylene-tetrafluoroethylenevinylidenefluoride) both also available from 3M Company as well as the TECNOFLON™ compositions identified as FOR-60KIR, FOR-LHF, NM, FOR-THF, FOR-TFS, TH, TN505 available from Montedison Specialty Chemical Co. Typically, these fluoroelastomers are cured with a nucleophilic addition curing system, such as a bisphenol crosslinking agent with an organophosphonium salt accelerator as described in further detail in the above referenced Lentz Patent and in U.S. Pat. No. 5,017,432. In a particularly preferred embodiment, the fluoroelastomer is one having a relatively low quantity of vinylidenefluoride, such as in VITON GF™, available from E.I. Dupont deNemours, Inc. The VITON GF™ has 35 weight percent vinylidenefluoride, 34 weight percent hexafluoropropylene and 29 weight percent tetrafluoroethylene with 2 weight percent cure site monomer. It is generally cured with bisphenol phosphonium salt, or a conventional aliphatic peroxide curing agent.

It is believed that some of the aforementioned haloelastomers and others that can be selected have the following formulas:

VITON E-45 ™

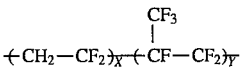

VITON GF ™

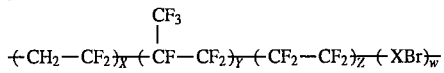

AFLAS ™

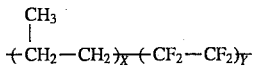

FLUOREL I ™

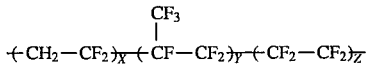

FLUOREL II ™

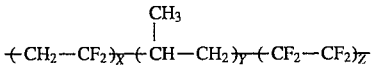

TECNOFLON ™

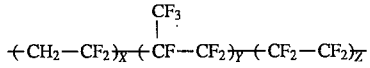

wherein the subscripts, such as x, y, and z, represent the number of repeating segments.

Other adjuvants and fillers may be incorporated in the elastomer in embodiments of the present invention providing they do not adversely affect the integrity of the fluoroelastomer. Such fillers normally encountered in the compounding of elastomers include coloring agents, reinforcing fillers, crosslinking agents, processing aids, accelerators and polymerization initiators. Adjuvants and fillers may be present in the conformable resistive layer in an amount ranging for example from about 5% to about 30% by weight, preferably from about 10% to about 15% by weight, based on the weight of the conformable resistive layer.

The conformable resistive layer has a thickness ranging for example from about 0.5 to about 50 mils, preferably from about 2 to about 10 mils, and more preferably about 5 mils.

The toner release layer may comprise any suitable material which is typically used as an overcoating layer for a conventional intermediate toner transfer component. In preferred embodiments, the release layer is chemically resistant to branched aliphatic hydrocarbons used in liquid developers, such as those used as non-polar insulating solvents sold under the tradenames ISOPAR™ and NORPAR™ by Exxon Chemical Corporation. The release layer also may exhibit minimal or no swelling in the liquid carrier and the conductivity of the release layer preferably is not affected by or is minimally affected in the presence of the liquid carrier.

Preferably, the release layer comprises a fluorosilicone having the liquid carrier resistant properties described herein. Fluorosilicones are illustrated in Bujese et al., U.S. Pat. No. 5,132,743, the disclosure of which is totally incorporated by reference. Preferred fluorosilicones are encompassed by the following illustrative formula:

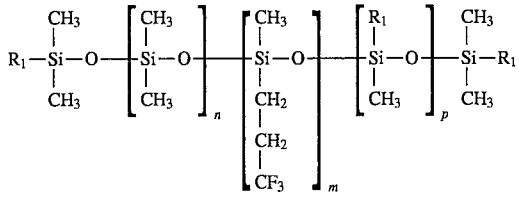

wherein $R_1$ can be methyl, vinyl, hydroxy, and alkoxy such as methoxy or ethoxy, and wherein when one $R_1$ substituent is methyl, the other two $R_1$ substituents preferably are other than methyl. Preferably, $R_1$ is vinyl. The total of m, n, and p is a value which may be greater than 350 and less than 3500, where m may be an integer which ranges for example from 200 to 1500, n may be an integer which ranges for example from 200 to 1500, and p ranges for example from 0 to 50. The fluorosilicone composition may be for instance Dow Corning DC 5-8749 or Dow Corning No. 94-003. The structural formulas of these two Dow Corning fluorosilicones are believed to be encompassed by the general fluorosilicone formula discussed herein. It is believed that the fluorosilicones disclosed herein when used in the release layer exhibit superior swell resistance in aliphatic hydrocarbons than silicon rubber. Swell resistance in an intermediate member is an important property because swelling tends to weaken a material.

The release layer has a thickness ranging for example from about 0.5 to about 50 mils, preferably from about 2 to about 10 mils, and more preferably about 5 mils. The release layer may include conductive particles, but in some embodiments of the present invention conductive particles are absent from the release layer.

Other adjuvants and fillers may be incorporated in the toner release layer in embodiments of the present invention providing they do not adversely affect the integrity of the release layer. Such fillers may include coloring agents, reinforcing fillers, crosslinking agents, processing aids, accelerators and polymerization initiators. Adjuvants and fillers may be present in the release layer in an amount ranging for example from about 5% to about 30% by weight, preferably from about 10% to about 15% by weight, based on the weight of the release layer.

The conformable resistive layer, the toner release layer, or both, may also comprise a volume grafted elastomer (referred herein as "volume graft") which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator. The fluoroelastomer is in embodiments selected from the group consisting of poly(vinylidene fluoride-hexafluoropropylene) and poly(vinylidene-hexafluoropropylene-tetrafluoroethylene), and the polyorganosiloxane in embodiments is of the formula:

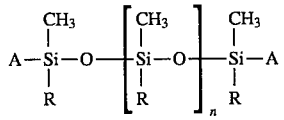

where R is an alkyl, alkenyl or aryl having, for example, less than 19 carbon atoms or an aryl group substituted with an amino, hydroxy, mercapto or alkyl or alkenyl group having less than 19 carbon atoms. The functional group A, is an alkene or alkyne with, for example, 1 to 10 carbon atoms, or an alkene or alkyne substituted with an alkyl or aryl having less than 19 carbon atoms, and n is 2 to 350. Alkyl, alkenyl and aryl examples are known and include methyl, ethyl, ethylene, propyl, propylene, butyl, butylene, pentyl, pentylene, phenyl, naphthyl, halobenzyl, and the like. In the formula, typical R groups include methyl, ethyl, propyl, octyl, vinyl, allyl crotnyl, phenyl, naphthyl and phenanthryl and typical substituted aryl groups are substituted in the ortho, meta and para positions with lower alkyl groups having less than 15 carbon atoms. Furthermore, in a preferred embodiment n is between 60 and 80 to provide a sufficient number of reactive groups to graff onto the fluoroelastomer. Typical alkene and alkenyl functional groups include vinyl, acrylic, crotonic and acetenyl which may typically be substituted with methyl, propyl, butyl, benzyl, and tolyl groups.

By volume graft, it is intended to refer in embodiments to a substantially uniform integral interpenetrating network of a hybrid composition, wherein both the structure and the composition of the fluoroelastomer and polyorganosiloxane are substantially uniform when taken through different slices of the intermediate toner transfer component. Interpenetrating network is intended to refer to the addition polymerization matrix where the fluoroelastomer and polyorganosiloxane polymer strands are intertwined in one another. Hybrid composition is intended to define a volume grafted composition which is comprised of fluoroelastomer and polyorganosiloxane blocks randomly arranged. An advantage of a release layer comprised of a volume graft is that the volume graft combines the swell resistance in aliphatic hydrocarbons of Viton type elastomers with the release characteristics of silicon rubber.

Examples of volume graft coating materials are comprised of VITON™ and a polysiloxane with optional fillers, reference U.S. Pat. No. 5,141,788 (D/89394D) and U.S. Pat. No. 5,340,679 (D/92564), the disclosures of which are totally incorporated herein by reference.

The dehydrofluorinating agent can be selected from the group consisting of primary, secondary and tertiary aliphatic and aromatic amines where the aliphatic and aromatic groups have from 2 to 15 carbon atoms, and aliphatic and aromatic diamines and triamines having from 2 to 15 carbon atoms, and more specifically, the dehydrofluorinating agent is a primary aliphatic amine such as an alkyl amine having up to 19 carbon atoms. The polymerization initiator can be selected from the group consisting of aliphatic and aromatic peroxides with benzoyl peroxide azoisobutyronitrile being preferred. The dehydrofluorinating agent, which attacks the fluoroelastomer generating unsaturation, is selected from the group of strong nucleophilic agents such as peroxides, hydrides, bases, oxides, etc. The preferred agents are selected from the group consisting of primary, secondary and tertiary, aliphatic and aromatic amines, where the aliphatic and aromatic groups have from 2 to 15 carbon atoms. It also includes aliphatic and aromatic diamines and triamines having from 2 to 15 carbon atoms where the aromatic groups may be benzene, toluene, naphthalene or anthracene etc.. It is generally preferred for the aromatic diamines and triamines that the aromatic group be substituted in the ortho, meta and para positions. Typical substituents include lower alkylamino groups such as ethylamino, propylamino and butylamino with propylamino being preferred. Specific amine dehydrofluorinating agents include N-(2-aminoethyl-3-aminopropyl)-trimethoxy silane, 3-(N-strylmethyl-2-aminoethylamino) propyltrimethoxy silane hydrochloride and (aminoethylamino methyl) phenethyltrimethoxy silane. The dehydrofluorinating agent generates double bonds by dehydrofluorination of the fluoroelastomer compound so that when the unsaturated functionally terminated polyorganosiloxane is added with the initiator, the free radical polymerization of the siloxane with the unsaturation sites of the fluoroelastomers is initiated. Typical free radical polymerization initiators for this purpose are benzoyl peroxide and azoisobutyronitrile, AIBN.

The volume grafting can be accomplished in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. Thus, the term "integral" as applied to the volume graft refers to the covalent bonding between the fluoroelastomer and the polyorganosiloxane.

The conformable resistive layer and the release layer may include conductive particles in the following illustrative amounts: about 3% to about 20% by weight, preferably about 5% to about 15% by weight, and more preferably about 10% by weight, based on the weight of the particular layer containing the conductive particles. The conductive particles may be for example carbon black, metal fibers, or powder particles of preferably sub-micron size to ensure good conductive linking throughout the material and for a good distribution during compounding. The metal fibers or powder particles may be aluminum, silver, or graphite. The conductive particles may have an arithmetic mean of the particle diameter from about 20 to about 30 millimicrons.

The following embodiments are preferred: the conformable resistive layer comprises a fluoroelastomer and conductive particles and the release layer comprises a fluorosilicone; the conformable resistive layer comprises a fluoroelastomer and conductive particles and the release layer comprises a substantially uniform integral interpenetrating network of a hybrid composition of a fluoroelastomer and a polyorganosiloxane; and the conformable resistive layer and the release layer both comprise a substantially uniform integral interpenetrating network of a hybrid composition of a fluoroelastomer and a polyorganosiloxane.

The first adhesive layer and the second adhesive layer may be the same or different composition, and may have thicknesses ranging for example from about 0.1 mil to about 3 mils, and more preferably from about 1 mil to about 2 mils. Examples of adhesives include: THIOXON 403/404™ and THIOXON 330/301™ both available from Morton International of Ohio; GE-2872-074™ available from the General Electric Company; a silane coupling agent such as Union Carbide A-1100 which is an amino functional siloxane; epoxy resins including bisphenol A epoxy resins available for example from Dow Chemical Company such as Dow TACTIX 740™, Dow TACTIX 741™, and Dow TACTIX 742™, and the like, optionally with a crosslinker or curative such as Dow H41 available from the Dow Chemical Company.

A preferred adhesive, especially for the first adhesive layer between the substrate and the conformable resistive layer, is GE-2872-074™ which is believed to be a copolymer of polyimide and siloxane. GE-2872-074™ is especially effective at bonding the conformable resistive layer to a substrate fabricated from a polyimide. The peel strength data indicates that the bonding between the conformable resistive layer and the polyimide substrate is very good and no debonding is noticed even when the bonded layers are soaked in a hydrocarbon liquid, NORPAR-15™, for an extended period of time at room temperature.

The intermediate toner transfer component of the present invention may be employed in any suitable electrostatographic printing apparatus. The printing apparatus can generate the electrostatic latent image by any appropriate methods and devices. For example, electrophotographic processes can be employed, wherein an image is formed on an imaging member by exposure of a photosensitive imaging member to light in an imagewise pattern. In addition, the image can be generated by ionographic processes, wherein the image is formed on a dielectric imaging member by applying a charge pattern to the imaging member in imagewise fashion.

Any suitable developing processes and materials can be employed by the printing apparatus of the instant invention to develop the latent image. For example, dry development processes can be employed, either single component development processes in which the developer material is comprised of black or color toner particles, or two component development processes, wherein the developer material comprises black or color toner particles and carrier particles. Typical dry toners and developers are also disclosed in, for example, U.S. Pat. No. 4,937,166, U.S. Pat. No. 4,935,326, U.S. Pat. No. 3,590,000, U.S. Pat. No. 3,079,342, and U.S. Pat. No. Re. 25,136, the disclosures of each of which are totally incorporated herein by reference. In addition, development can be effected with liquid developers comprised of a liquid carrier and black or color toner particles dispersed therein. Liquid developers are disclosed, for example, in U.S. Pat. No. 2,890,174 and U.S. Pat. No. 2,899,335, and copending patent applications U.S. Ser. No. 986,316 (D/91310), U.S. Ser. No. 013,132 (D/90095C), U.S. Ser. No. 009,202 (D/92570) and U.S. Ser. No. 009,192 (D/92571), the disclosures of each of which are totally incorporated herein by reference.

Any suitable conventional electrophotographic development technique can be utilized to deposit toner particles on the electrostatic latent image on the imaging member. Well known electrophotographic development techniques include magnetic brush development, cascade development, powder cloud development, electrophoretic development, and the like. Magnetic brush development is more fully described in, for example, U.S. Pat. No. 2,791,949, the disclosure of which is totally incorporated herein by reference; cascade development is more fully described in, for example, U.S. Pat. No. 2,618,551 and U.S. Pat. No. 2,618,552, the disclosures of each of which are totally incorporated herein by reference; powder cloud development is more fully described in, for example, U.S. Pat. No. 2,725,305, U.S. Pat. No. 2,918,910, and U.S. Pat. No. 3,015,305, the disclosures of each of which are totally incorporated herein by reference; and liquid development is more fully described in, for example, U.S. Pat. No. 3,084,043, the disclosure of which is totally incorporated herein by reference.

The intermediate transfer component employed for the present invention can be of any suitable configuration. Examples of suitable configurations include a sheet, a web, a foil, a strip, a coil, a cylinder, a drum, an endless belt, an endless mobius strip, a circular disc, or the like. Typically, the transfer element has a thickness of from about 2 to about 10 mils.

The coated toner transfer components, or belts of the present invention in embodiments can have a charge relaxation time of no more than about $2\times10^2$ seconds to ensure efficient transfer from the intermediate to the substrate. The lower limit of suitable charge relaxation times is theoretically unlimited, and conductive materials, such as metals, can be employed as the transfer element. While not being limited by any theory, however, it is believed that the lower limit on the charge relaxation time for an intermediate transfer element in any given situation will be determined by the conductivity of the receiving substrate to which the toner image is ultimately transferred. Specifically, no shorting should occur between the intermediate transfer component and the substrate around the toner piles constituting the image, since shorting would result in little or no transfer field to effect transfer from the intermediate to the substrate. Typically, for transfer to paper, the charge relaxation time is from about $1\times10^{-3}$ seconds to about $2\times10^2$ seconds. The charge relaxation time ($\tau$) of a material is generally a function of the dielectric constant (K), the volume resistivity ($\rho$) of that material, and the permittivity of free space ($\epsilon_0$, a constant equal to $8.854\times10^{-14}$ farads per centimeter), wherein $\tau=K\epsilon_0\rho$.

The intermediate transfer components of the instant invention may be employed in either an image on image transfer or a tandem transfer of a toned image(s) from the photoreceptor to the intermediate transfer component. In an image on image transfer, the color toner images are first deposited on the photoreceptor and all the color toner images are then transferred simultaneously to the intermediate transfer component. In a tandem transfer, the toner image is transferred one color at a time from the photoreceptor to the same area of the intermediate transfer component.

The developed image on the coated intermediate transfer element is subsequently transferred to a substrate. Preferably, prior to transfer the developed image on the intermediate is charged by, for example, exposure to a corotron to ensure that all of the toner particles are charged to the same polarity, thereby enhancing transfer efficiency by eliminating any wrong-sign toner. Wrong-sign toner is toner particles that have become charged to a polarity opposite to that of the majority of the toner particles and the same as the polarity of the latent image. Wrong-sign toner particles typically are difficult to transfer to a substrate. Examples of substrates include paper, transparency material such as polyester, polycarbonate, or the like, cloth, wood, or any other desired material upon which the finished image will be situated. If desired, the transferred developed image can thereafter be fused to the substrate by conventional means. Typical, well known electrophotographic fusing techniques include heated roll fusing, flash fusing, oven fusing, laminating, vapor fusing, adhesive spray fixing, and the like.

Transfer of the developed image from the imaging member to the intermediate transfer element and transfer of the image from the intermediate transfer element to the substrate can be by any suitable technique conventionally used in electrophotography, such as corona transfer, pressure transfer, bias roll transfer, and combinations of those transfer means, and the like. In the situation of transfer from the intermediate transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles. A single wire corotron having applied thereto a potential of between about 5,000 and about 8,000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing member to the image receiving member. After transfer, a corona generator charges the receiving member to an opposite polarity to detack the receiving member from the member that originally bore the developed image, whereupon the image receiving member is separated from the member that originally bore the image.

Bias roll transfer is another method of effecting transfer of a developed image from one member to another. In this process, a biased transfer roller or belt rolls along the surface of the receiving member opposite to the surface that is to receive the developed image. Further data concerning bias roll transfer methods is provided in, for example, U.S. Pat. No. 3,847,478, U.S. Pat. No. 3,942,888, and U.S. Pat. No. 3,924,943, the disclosures of each of which are totally incorporated herein by reference.

A description of a preferred printing apparatus follows. In particular, the intermediate transfer member can be employed in an electrophotographic imaging system for electrostatic transfer of a toner image wherein the system comprises at least one image forming device, reference U.S. Ser. No. 957,140 (D/92071), the disclosure of which is totally incorporated herein by reference. Typically, four image forming devices are utilized. The image forming devices may each comprise an image receiving member in the form of a photoreceptor about which are positioned image forming components of the imaging structure. The image forming components further comprise exposure structures, developing structures, transfer structures, cleaning structures and charging structures. Charging structures can comprise conventional corona discharge devices. The intermediate transfer member of the invention, such as an intermediate transfer belt, is supported for movement in an endless path such that incremental portions thereof move past the image forming components for transfer of an image from each of the image receiving members. Each image forming component is positioned adjacent the intermediate transfer member for enabling sequential transfer of different color toner images to the intermediate transfer member in superimposed registration with one another.

Exposure structures employed can be any suitable type employed in the art. Typical exposure structures employed include, but are not limited to, raster input/output scanning devices (RIS/ROS) or any combination using the RIS/ROS devices. The light source employed can be any suitable light source employed in the art, such as a laser.

The intermediate transfer member is used in a manner that enables each incremental portion thereof to move past an image forming component. A color image component corresponding to a yellow component of an original document to be copied may be formed on the image receiving member (photosensitive drum or photoreceptor) using the charging structure, the exposure structure and the developing structure. The developing structure develops a yellow toner image on the image receiving member. A transfer structure, which can comprise a corona discharge device, serves to effect transfer of the yellow component of the image at the area of contact between the receiving member and the intermediate transfer member.

Also, in a similar manner, magenta, cyan and black image components corresponding to magenta, cyan and black components of the original document also can be formed on the intermediate transfer member one color on top of the other to produce a full color image.

The intermediate transfer member is moved through a transfer station wherein the multicolored image is electrostatically transferred to a transfer sheet or copy sheet. The transfer sheet or copy sheet itself may be electrostatically charged with a corotron device at the transfer station. The transfer sheet or copy sheet is moved into contact with the toner image at the transfer station. The sheet is advanced to the transfer station by any suitable sheet feeding apparatus. For example, feed rollers rotate so as to advance the uppermost sheet from a stack of sheets into contact with the intermediate transfer member in times sequence so that the toner powder image thereon contacts the advancing sheet at the transfer station. At the transfer station, a Biased Transfer Roll (BTR) is used to provide good contact between the sheet and the toner image during transfer. A corona transfer device also can be provided for assisting the BTR in effecting image transfer. These imaging steps can occur simultaneously at different incremental portions of the intermediate transfer member.

Suitable devices in which the intermediate transfer member of the present invention can be employed include, but are not limited to, devices described in U.S. Pat. Nos. 3,893,761; 4,531,825; 4,684,238; 4,690,539; 5,119,140 and 5,099,286, the disclosures of which are totally incorporated herein by reference. The intermediate transfer member of the present invention can dissipate charge between toner image stations. It achieves transfer efficiencies of close to 100 percent and has nonstretch characteristics enabling good registration of a toner image.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated. As used herein, room temperature, ambient temperature, and ambient conditions refer to a temperature of about 25° C.

EXAMPLE 1

Two polyimide substrates (thickness about 3 mils), filled with indium tin oxide, having resistivity of $10^{-10}$ ohms/sq were obtained from E.I.DuPont de Nemours & Company and were tape seamed into a belt shape. General Electric Co. adhesive GE2872-074 was then applied to a thickness of 2 to 3 tenths of a mil (5 to 7.5 micrometers), air dried at ambient conditions for 30 minutes and baked at 150° C. for 30 minutes. Subsequently, the primed belts were provided with a coating of a volume graft elastomer which was prepared by dissolving 250 grams of VITON GF™ in 2.5 liters of methylethyl ketone (MEK) by stirring at room temperature. This was accomplished by using a 4 liter plastic bottle and a moving base shaker for about one hour to two hours to accomplish the dissolution depending upon the speed of the shaker. The above solution was then transferred to a 5 liter Erlenmeyer flask and 25 milliliters of the amine dehydrofluorinating agent, 3-(N-strylmethyl-2-aminoethylamino) propyltrimethoxysilane hydrochloride (S-1590, available from Huls America Inc. Piscataway, N.J.) was added. The contents of the flask were then stirred using a mechanical stirrer while maintaining the temperature between 55° and 60° C. After stirring for 30 minutes, 50 milliliters of 100 centistoke vinyl terminated polysiloxane (PS-441) also available from Huls America Inc. was added and stirring was continued for another ten minutes. A solution of 10 grams of benzoyl peroxide in a 100 milliliter mixture of toluene and MEK (80:20) was then added. The stirring was continued while heating the contents of the flask at about 55° C. for another 2 hours. During this time, the color of the solution turned light yellow, the solution was then poured into an open tray. The tray was left in the hood overnight (16 hours). The resulting yellow rubbery mass left after the evaporation of the solvent was then cut into small pieces with a scissor. This material was then extracted extensively and repeatedly with 1,500 milliliters (three 500 milliliter portions) of n-hexane to remove unreacted siloxane.

Thereafter, 110 grams of the prepared silicone grafted fluoroelastomer, together with 1000 grams of methyl isobutyl ketone and 22 grams of Regal R250 carbon black available from Cabot Corporation were added to a jar containing ceramic balls (media) followed by roll milling for 48 hours. To the above mixture 2.2 grams of magnesium oxide and 1.10 gram of calcium hydroxide $(CaOH)_2$ were added and contents of the jar were ball milled for an additional 17 to 24 hours until a fine, 3 to 5 microns in diameter particle size of the fillers in dispersion was obtained. Subsequently, 5.0 grams of DuPont Curative VC50™ catalyst crosslinker in 45 parts of methyl ethyl ketone were added to the above dispersion, shaken for about 15 minutes and the solids content reduced to 5 to 7 percent by the addition of methyl isobutyl ketone. Following hand mixing, the mixture was air sprayed on to the above primed belts to a dry thickness of about 4.5 mils (112.5 micrometers) and cured in ambient dry air for 24 hours followed by the above-mentioned post step curing procedure, that is heating for 2 hours at 93° C., heating for 2 hours at 149° C., heating for 2 hours at 177° C., and thereafter heating for 16 hours at 208° C., followed by cooling. A layer of General Electric Co. adhesive GE2872-074 was then applied to both the belts as before to a thickness of 2 to 3 tenths of a mil (5 to 7.5 micrometers). Subsequently, these primed belts were provided with the top coats as mentioned in the examples 1A and 1B.

EXAMPLE 1A

Belt Structure With Fluorosilicone Over Volume Graft

To one of the above belts a top coat of fluorosilicone polymer was fabricated by the following techniques. Fluorosilicone LSR kit, Q5-8601 was obtained from Dow Corning Co., having a chemical formula believed to be encompassed by the general fluorosilicone structure disclosed herein. The kit contained fluorosilicone LSR, in two parts, part A and Part B. Both part A and B were added to 2000 grams of methyl isobutyl ketone in a ball jar containing ceramic media followed by ball milling for 1 hour. The resulting dispersion was then spray coated on the above belt to a dry thickness of 2.0 mils. The fluorosilicone top layer was then cured in ambient dry air for 24 hours followed by heating at 110 C. The resulting belt was comprised of resistive polyimide as substrate, volume graft/carbon black middle layer, and fluorosilicone as the top layer.

EXAMPLE 1B

Belt Structure With Volume Graft Over Volume Graft

To the second belt a top coat of volume graft was put on by the following method. About 54.5 grams of the prepared silicone grafted fluoroelastomer, together with 495 grams of methyl isobutyl ketone, 1.1 grams of magnesium oxide and 0.55 gram of calcium hydroxide $(CaOH)_2$ were added to a jar containing ceramic balls followed by roll milling for (media) 17 to 24 hours until a fine, 3 to 5 microns in diameter particle size of the fillers in dispersion was obtained. Subsequently, 2.5 grams of DuPont Curative VC50™ catalyst crosslinker in 22.5 parts of methyl ethyl ketone were added to the above dispersion, shaken for about 15 minutes and the solids content reduced to 5 to 7 percent by the addition of methyl isobutyl ketone. Following hand mixing, the mixture was air sprayed on to the above primed belt to a dry thickness of about 1.5 mils and cured in ambient dry air for 24 hours followed by the above-mentioned post step curing procedure, that is heating for 2 hours at 93° C., heating for 2 hours at 149° C., heating for 2 hours at 177° C., and thereafter heating for 16 hours at 208° C., followed by cooling. The resulting belt was comprised of resistive polyimide as substrate, volume graft/carbon black middle layer, and volume graft as the top layer.

EXAMPLE 2

Two electrically resistive polyimide belts (thickness about 3 mils) obtained from Gunze Corporation of America, New York, were primed with General Electric adhesive GE-2872-074 as mentioned in Example 1. A solution of Viton GF was prepared by dissolving 250 grams of Viton GF in 2.5 liters of methyl ethyl ketone by stirring at room temperature, about 25° C. To 2 liters of this solution, there were added in a reaction vessel 2.2 grams of magnesium oxide, 1.1 grams of calcium hydrooxide, 5.5 grams of E.I. DuPont Curative VC-50, and 5 grams of carbon black Regal R250 obtained from Cabot Corporation. The contents of the vessel were ball milled with media for 17 to 24 hours until a fine, 3 to 5 microns in diameter particle size of the fillers in dispersion was obtained. The resulting black dispersion was then air sprayed on to the above primed belts to a dry thickness of about 4.5 mils (112.5 micrometers) and cured in ambient dry air for 24 hours followed by the above-mentioned post step curing procedure, that is heating for 2 hours at 93° C., heating for 2 hours at 149° C., heating for 2 hours at 177° C., and thereafter heating for 16 hours at 208° C., followed by cooling. A layer of General Electric Co. adhesive GE2872-074 was then applied to both the belts as before to a thickness of 2 to 3 tenths of a mil (5 to 7.5 micrometers). Subsequently, these primed belts were provided with the top coats as mentioned in the Examples 2A and 2B.

EXAMPLE 2A

Belt Structure With Fluorosilicone Over Viton GF

A top coat of fluorosilicone of a thickness of 1.5 mils was put on to one of the above belts using exactly the same procedure and materials as described in Example 1A. The resulting belt structure was comprised of electrically conductive polyimide substrate, Viton GF filled with carbon black as the middle layer and fluorosilicone as the top layer.

EXAMPLE 2B

Belt Structure With Volume Graft Over Viton GF

A top coat of volume graft of a thickness of 1.5 mils was put on to one of the above belts using exactly the same procedure and materials as described in Example 1B. The resulting belt structure was comprised of electrically conductive polyimide substrate, Viton GF filled with carbon black as the middle layer and volume graft as the top layer.

EXAMPLE 3

The belts of Examples 1A & B and Examples 2A & B were then placed in a laboratory liquid development test fixture, and all these belts had excellent toner transfer efficiencies, as measured by a densitometer RD918 available from Macbeth Inc. of New York, where these belts had excellent characteristics enabling superior transfer of developed xerographic latent images. There was achieved with each of the belts excellent toner transfer efficiency, as measured with the Macbeth densitometer, of 100 percent both from the photoreceptor to the belts and from the belt to paper.

The above prepared belts were also incorporated into a laboratory dry toner development similar to a Xerox Corporation 5090 duplicator test fixture, and there was measured transfer efficiences of close to 100 percent from the imaging member to each of the belts and from each of the belts to paper. The developed images on the paper were then fixed by conventional heat and pressure means.

COMPARATIVE EXAMPLE

A belt was prepared having a substrate and only one overcoating wherein the overcoating was comprised of VITON B-50®, a material available from E.I. DuPont and believed to be a fluoropolymer comprised of a terpolymer of vinylidene fluoride, hexafluoropropylene, and tetrafluoroethylene with a mole ratio of 61:17:22.

A solution of VITON B-50® was prepared by dissolving 250 grams of the B-50 in 2.5 liters of methylethyl ketone (MEK) by stirring at room temperature, about 25° C. To 2 liters of this solution, there were added in a reaction vessel 2.2 grams of magnesium oxide, 1.1 grams of calcium hydroxide, 5.5 grams of E.I. DuPont Curative VC50™, and 5 grams of carbon black N991 obtained from Vanderbilt Corporation. The contents of the vessel were ball milled with media for 17 hours. The resulting black dispersion containing the VITON B-50® was then spray coated to a dry thickness of about 4 mils onto a stainless steel belt (thickness about 3 mils). This belt was then incorporated into the liquid imaging apparatus of Example 3, and it was determined using the Macbeth densitometer that only 85 percent of the liquid toner transferred from the photoreceptor to the belt and 80 percent from the belt to paper.

Similarly, the above prepared belt was incorporated into the dry development test fixture of Example 3, and the toner transfer efficiency was about 80 percent from the imaging member to the belt, and from the belt to paper.

Other modifications of the present invention may occur to those skilled in the art based upon a reading of the present disclosure and these modifications are intended to be included within the scope of the present invention.

We claim:

1. An intermediate toner transfer component comprising:

(a) an electrically conductive substrate;

(b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

2. The transfer component of claim 1, wherein the resistive layer comprises the first polymeric material and conductive particles.

3. The transfer component of claim 2, wherein the conductive particles are carbon black.

4. The transfer component of claim 1, wherein the first polymeric material is selected from the group consisting of a haloelastomer and a substantially uniform integral interpenetrating network of a hybrid composition of a fluoroelastomer and a polyorganosiloxane.

5. The transfer component of claim 1, wherein the release layer resists absorption of the liquid carrier of a liquid developer.

6. The transfer component of claim 1, wherein the resistive layer comprises a fluoroelastomer and conductive particles and the release layer comprises a fluorosilicone.

7. The transfer component of claim 1, wherein the resistive layer comprises a fluoroelastomer and conductive particles and the release layer comprises a substantially uniform integral interpenetrating network of a hybrid composition of a fluoroelastomer and a polyorganosiloxane.

8. The transfer component of claim 1, wherein the resistive layer and the release layer both comprise a substantially uniform integral interpenetrating network of a hybrid composition of a fluoroelastomer and a polyorganosiloxane.

9. The transfer component of claim 1, further comprising a first adhesive layer disposed between the substrate and the resistive layer.

10. The transfer component of claim 9, wherein the first adhesive layer comprises a copolymer of polyimide and siloxane.

11. The transfer component of claim 1, further comprising a second adhesive layer disposed between the release layer and the resistive layer.

12. The transfer component of claim 11, wherein the second adhesive layer comprises a copolymer of polyimide and siloxane.

13. An electrostatographic printing apparatus comprising:

(a) an imaging member for recording a latent image;

(b) a developing device for developing the latent image with a toner composition to form a toner image;

(c) an intermediate toner transfer component, positioned adjacent the imaging member, comprising:

(i) an electrically conductive substrate, (ii) a conformable and electrically resistive layer comprised of a first polymeric material, and (iii) a toner release layer comprised of a second polymeric material selected from the group consisting of a fluorosilicone and a substantially uniform integral interpenetrating network of a hybrid composition of a fluoroelastomer and a polyorganosiloxane; and (d) a transfer apparatus for transferring the toner image from the imaging member to the intermediate toner transfer component.

14. The apparatus of claim 13, wherein the developing device includes a liquid developer.

* * * * *